United States Patent [19]

Nikulainen

[11] Patent Number: 4,566,381

[45] Date of Patent: Jan. 28, 1986

[54] DRUM PRESS FOR SEPARATING LIQUID FROM SOLID SUBSTANCE

[75] Inventor: Matti J. Nikulainen, Pietarsaari, Finland

[73] Assignee: Kone Oy, Helsinki, Finland

[21] Appl. No.: 612,243

[22] Filed: May 21, 1984

[51] Int. Cl.[4] ..... B30B 9/20

[52] U.S. Cl. ..... 100/121; 100/157

[58] Field of Search ..... 100/121, 157, 905, 907

[56] References Cited

U.S. PATENT DOCUMENTS

| | | | |
|---|---|---|---|
| 390,651 | 10/1888 | Crawford | 100/121 X |
| 2,795,184 | 6/1957 | Graham et al. | 100/121 |
| 3,000,294 | 9/1961 | Lowe et al. | 100/121 |
| 3,086,454 | 4/1963 | Asplund | 100/121 |

*Primary Examiner*—Peter Feldman

*Attorney, Agent, or Firm*—Martin Smolowitz

[57] ABSTRACT

A drum press for separating liquid from solid substance, the drum press consisting of two different sized, cylindrical, perforated drums rotating one within the other around different centers, between the envelope surfaces of which the liquid is pressed out from the substance being pressed, and the outer drum being provided with non-rotating end plates disposed with requisite clearance in relation to the rotating outer drum. The inner drum provided with a shaft passes through the non-rotating end plates of the outer drum with requisite clearance, and in its shell and in its end plates fixed on the shaft have been made, towards the shell, apertures, through which the liquid that has entered the drum during the pressing operation is enabled freely to flow out from the drum.

5 Claims, 4 Drawing Figures

DRUM PRESS FOR SEPARATING LIQUID FROM SOLID SUBSTANCE

BACKGROUND OF INVENTION

The present invention concerns a drum press for separating liquid from solid substance, said drum press consisting of two different sized, cylindrical, perforated drums rotating one within the other around different centres, and between the envelope surfaces of which the liquid from the substance being pressed is pressed out, and said outer drum being provided with non-rotating end plates disposed with an appropriate clearance to the rotating outer drum.

In cylindrical drum presses in current use, the inner drum is frequently unperforated because it is inconvenient, expensive or outright impossible to conduct the liquid away from the inner drum, owing to the construction of such presses. A perforated inner drum in the press increases the hole surface to be nearly double in the pressing situation, and using the same pressures as in a press with unperforated inner drum, better pressing results are achieved because the liquid may pass out from the substance being pressed by a shorter route when the pressing thickness is the same, that is, of two equal-sized presses the one with perforated inner drum has about double capacity in terms of matter to be pressed, with unchanged result of the pressing operation.

DESCRIPTION OF INVENTION

The object of the present invention is to provide a drum press of a novel type. The drum press of the invention is characterized in that the inner drum, fitted with a shaft, passes through the non-rotating end plates of the outer drum with requisite clearance, and in its shell and in the end plates fixed on the shaft, apertures known in themselves in the art have been made on the side towards the shell, through which the liquid that has entered the inner drum in the pressing operation can freely flow out from the drum. In this manner, the liquid that is being pressed into the inner drum can be removed with a drum press of simple design configuration.

Figure 1:
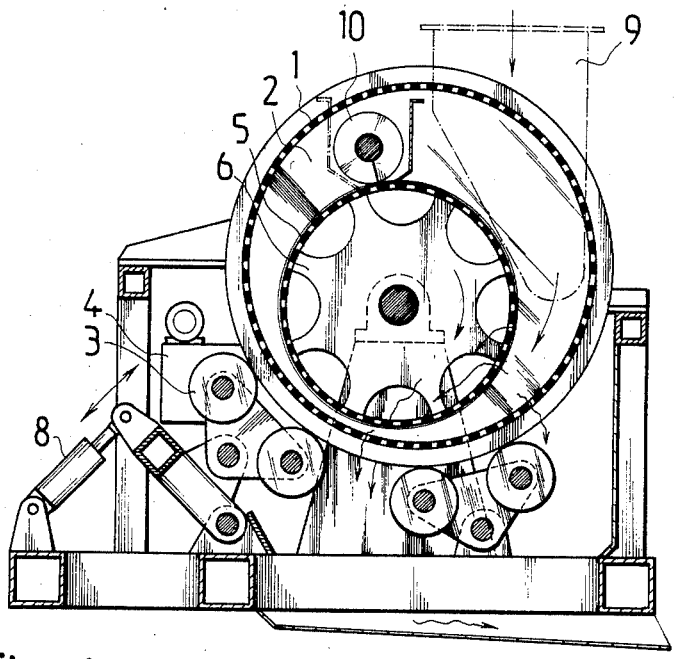
Figure 2:
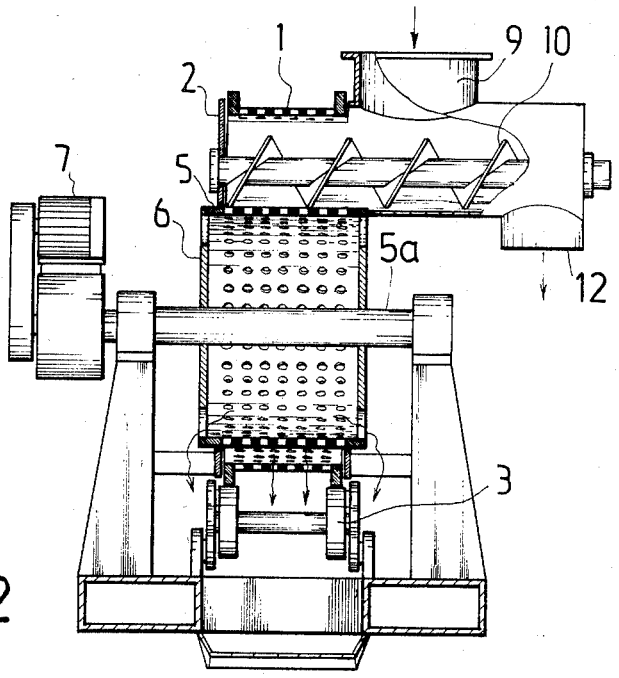

The invention is described in the following with the aid of an example, with reference to the attached drawings, wherein FIGS. 1 and 2 present sectional elevation views of the inner drum of a drum press, for which the end plates of the outer drum are stationary.

Figure 3:
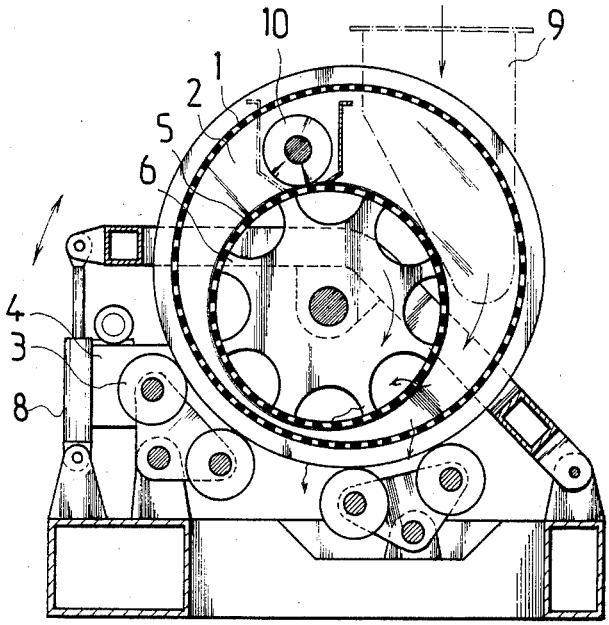
Figure 4:
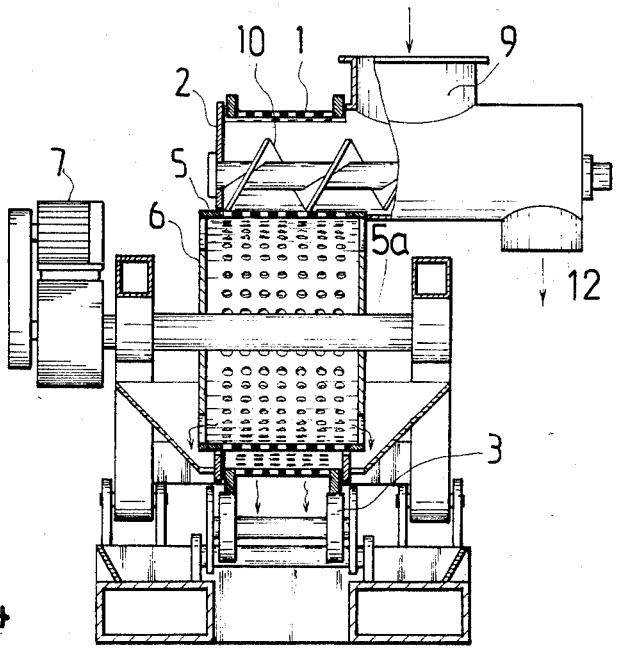

FIGS. 3 and 4 present an alternative drum press in which the outer drum is stationary, and the inner drum and the end plates of the outer drum move together.

The press according to the invention consists of two different sized, cylindrical, perforated drums 1,5 rotating around different centres, between the envelope surfaces of outer drum 1 and inner drum 5 the liquid is pressed out from the substance to be pressed. The liquid departs from the substance being pressed, through the holes in the envelope surfaces of the outer and inner drums. The outer drum 1 is provided with non-rotating end plates 2, disposed with requisite clearance in relation to the rotating outer drum. The outer drum 1 rotates on sets of wheels 3 with bogie at the end flanges of the drum. If needed, the wheels are provided with a drive 4. The inner drum 5, provided with a shaft 5*a*, passes through the non-rotating end plates 2 of the outer drum with requisite clearance, and its shell and the end plates 6 affixed to the shaft 5*a* have been pierced towards the shell with apertures, through which the liquid that has accumulated in the drum in the pressing operation will rapidly flow out from the drum. The inner drum 5 is provided with a drive 7 and rotatably carried by the shaft. In order to achieve a given, desired compression acting on the substance to be pressed between the drums, one of the two drums is urged against the other with the aid of hydraulic or mechanical loading apparatus 8. The peripheral velocity of the drums is selected to suit the type of material that is being pressed, so as to elicit the best result possible. The substance to be pressed is fed into the press with a feed hopper 9 or directly by a screw conveyor. The pressings are removed with a screw conveyor 10, using scrapers if necessary at outlet 12.

I claim:

1. A drum press for separating liquid from solid substance, said drum press comprising: an outer cylindrical perforated drum rotatable by a support means;

an inner perforated drum rotating within said outer drum and each drum rotating around different centers, so that between the envelope surfaces of the two drums a liquid is pressed out from the solid substance being pressed, said outer drum being provided with non-rotating end plates disposed with requisite clearance in relation to the rotating outer drum, wherein the inner drum is provided with a shaft and with end plates and a shell which passes through the non-rotating end plates of the outer drum with requisite clearance, the inner drum being provided in its shell and in its end plates fixed on the shaft with apertures towards the shell, through which apertures the liquid that has entered the inner drum during the solids substance pressing operation is enabled freely to flow out from the inner drum.

2. A drum press according to claim 1, wherein said outer drum is supported and rotated about a horizontal center line by drive wheels contacting the drum outer periphery.

3. A drum press according to claim 1, wherein said inner drum is rotated by drive means connected to said shaft.

4. A drum press according to claim 1, wherein said outer drum is urged against the periphery of the inner drum by a suitable loading mechanism.

5. A drum press for separating liquid from solid substance, said drum press comprising:

an outer cylindrical perforated drum rotatable about a horizontal center by drive wheels contacting the outer periphery;

an inner perforated drum rotating within said outer drum and each drum rotating around different horizontal centers, so that between the envelope surfaces of the outer and inner drums a liquid is pressed out from the solid substance being pressed, said outer drum being provided with a non-rotating end plate disposed at each end of the drum with requisite clearance in relation to the rotatable outer drum, wherein said inner drum is provided with a rotatable drive shaft and with end plates and a shell which passes through the non-rotating end plates of the outer drum with requisite clearance, the inner drum being provided with apertures in its shell and in its end plates fixed on the shaft and towards the shell, through which apertures the liquid that has entered the inner drum during the solid substance pressing operation is enabled freely to flow out from the inner drum.

* * * * *